US005193433A

United States Patent [19]

Reimer

[11] Patent Number: 5,193,433

[45] Date of Patent: Mar. 16, 1993

[54] PISTON SEALING AND DAMPENING DEVICE

[75] Inventor: Jens Reimer, Stockholm, Sweden

[73] Assignee: AB Mecman, Stockholm, Sweden

[21] Appl. No.: 775,926

[22] PCT Filed: Apr. 25, 1990

[86] PCT No.: PCT/SE90/00278

§ 371 Date: Nov. 1, 1991

§ 102(e) Date: Nov. 1, 1991

[87] PCT Pub. No.: WO90/14520

PCT Pub. Date: Nov. 29, 1990

[30] Foreign Application Priority Data

May 24, 1989 [SE] Sweden ..... 8901851

[51] Int. Cl.[5] ..... F01B 11/07

[52] U.S. Cl. ..... 92/85 B; 92/107; 92/240; 92/245; 91/27; 91/31; 91/409

[58] Field of Search ..... 92/85 B, 107, 108, 240, 92/245; 91/27, 31, 404, 409, 408

[56] References Cited

U.S. PATENT DOCUMENTS

| | | | |
|---|---|---|---|
| 2,935,047 | 5/1960 | Ortman et al. | 91/408 |
| 3,267,815 | 8/1966 | Ortman et al. | 91/408 |
| 3,296,942 | 1/1967 | Nelson | 91/409 |
| 3,835,753 | 9/1974 | Bunyard | 92/85 B |

FOREIGN PATENT DOCUMENTS

| | | | |
|---|---|---|---|
| 714881 | 8/1965 | Canada | 92/85 B |
| 794062 | 4/1958 | United Kingdom | 91/31 |

*Primary Examiner*—Thomas E. Denion

*Attorney, Agent, or Firm*—Townsend and Townsend

[57] ABSTRACT

Piston sealing and dampening device in a pressurized-fluid cylinder, where a piston (3) has a central recess (3*a*) facing towards a cylinder end cap (1*a*) and disposed such that when the piston is in the vicinity of its end position, said recess accommodates a sleeve portion (5) provided with an internal pressurized-fluid connection (6) and projecting from the cylinder end cap. An integrated sealing ring (10) seals against the outside of the sleeve portion (5) with an inner sealing ring lip (10*e*) and against the inside of the cylinder tube (2) with an outer sealing ring lip (10*c*).

10 Claims, 3 Drawing Sheets

PISTON SEALING AND DAMPENING DEVICE

The invention relates to a piston sealing and dampening device of the kind disclosed in the preamble to claim 1.

Such a device is known from EP-B-1-0082829 (relating to a so-called slot cylinder), the inner and outer sealing ring lips each being formed on a separate sealing ring. One sealing ring is inserted in a circumferential groove on the outer cylindrical surface of the piston, while the other sealing ring is placed in an external groove on the sleeve portion projecting into the cylinder chamber. By this arrangement the separate sealing rings can indeed fulfil their respective functions, i.e. piston sealing and end position dampening, but most fabrication and assembly will be relatively complicated and costly.

The object to the present invention is to provide, against this background, an integrated device, which in a simple way functions both as end position dampening and piston sealing means. This object is achieved by a device having the characterizing features stated in claim 1.

The following advantages are thus obtained:

an integrated sealing ring serves both as end position dampening and piston sealing means;

the implementation is simple and cheap, and assembly can be carried out rapidly in series production;

by the intermediate web portion of the sealing ring, covering the end surface of the piston, the ring can also serve as an impact dampening and sound silencing means when the piston strikes against the cylinder end cap.

Further advantageous distinguishing features are disclosed in the sub-claims and will be apparent from the detailed description below, referance being made to the accompanying drawings, where FIG. 1A, 1B and 1C are central, longitudinal sections of an embodiment of the inventive device, for a single-acting pressurized-fluid cylinder, in three different positions of the piston;

Figure 1A:
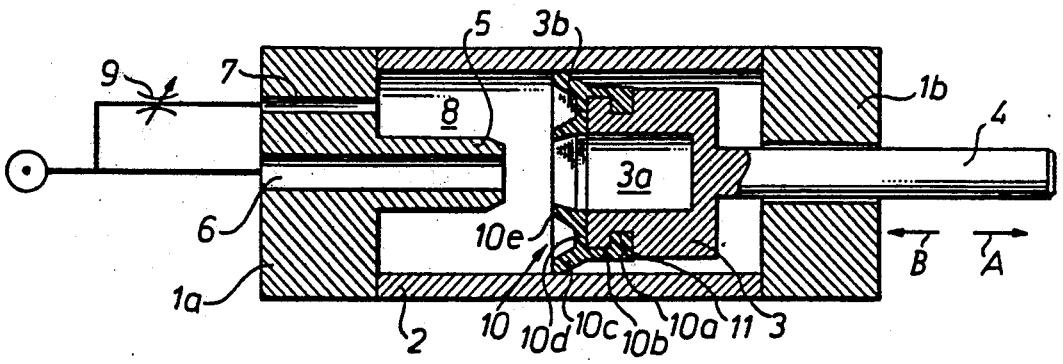
Figure 1B:
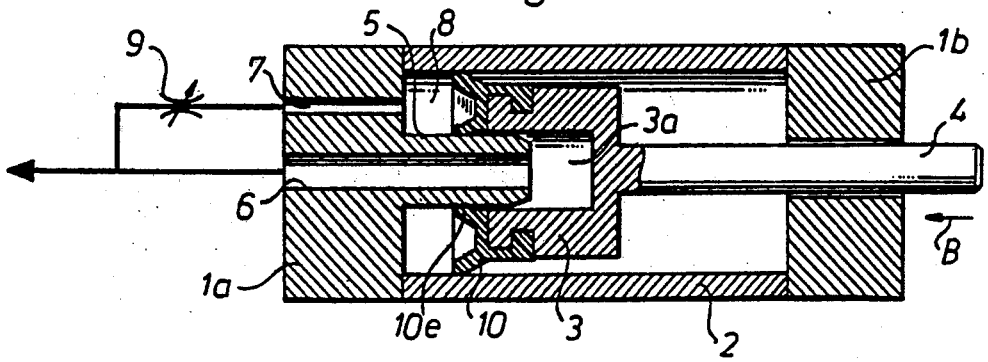
Figure 1C:
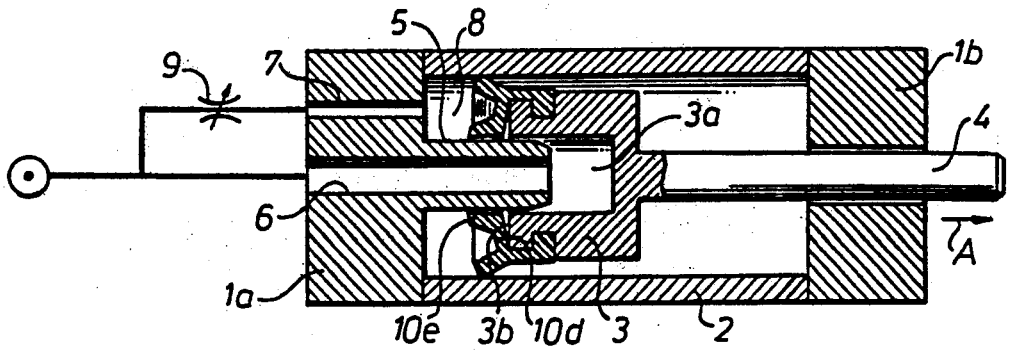

In FIGS. 1A, 1B and 1C there is schematically illustrated a single-acting pneumatic cylinder with opposite end caps 1*a*, 1*b*, a cylinder tube 2 and a piston 3, having its piston rod 4 projecting out through an opening in the end cap 1*b*. The necessary sealing members between the cylinder tube and end caps, the bushing for the piston rod and the pressurized-air connections have been excluded on the drawings, since these components do not have any essential importance for the invention.

The piston 3 is formed with a central, cylindrical recess 3*a* facing towards the end cap 1*a*, such that when the piston approaches the left end position in the figures, the piston accommodates a circular-cylindrical sleeve portion 5 projecting into the cylinder chamber from the end cap 1*a*. The central bore in this cylindrical portion 5 communicates with the pressurized-air port 6 of the cylinder for supply and discharge of pressurized-air to and from the active cylinder chamber to the left of the piston 3.

In the region of the sleeve portion 5 there is formed an annular space between the outside of the sleeve portion 5 and the inside of the cylinder tube 2 adjacent the end cap 1*a*. A duct 7 connected to an adjustable constriction 9 and passing through the end cap opens into this annular space 8.

The piston 3 is provided with a sealing ring 10, which in accordance with the invention has the task of sealing against the inside of the cylinder tube 2 to serve as a piston seal, and also against the outside of the sleeve portion 5 to serve as end position dampening means, since in the piston position illustrated in FIG. 1B it encloses air in the space 8 (which can only be discharged via the constriction 9). The sealing ring 10 has a radially outward part provided with a fastening bead 10*a*, which is accommodated in a circumferential groove 11 on the piston 3. The sealing ring is also provided with an axially extending portion 10*b* merging into an outer sealing lip 10*c* extending at an angle outwards against the inside of the tube 2 in a direction towards the end cap 1*a*.

A radially inwardly extending intermediate web portion 10*d* merges with the radially outward part 10*a*, 10*b*, 10*c* of the ring and normally engages against the end surface 3*b* facing towards the end cap 1*a* of the piston 3, this web merging into a radially inwardly directed sealing lip 10*e*, which normally (FIG. 1A and 1B) extends at an angle inwards towards the outside of the sleeve portion 5 in a direction towards the end cap 1*a*.

The piston sealing and dampening device functions in the following manner. When the piston 3 is between its end positions, axially spaced from the sleeve portion 5, the outer sealing ring lip 10*c* engages sealingly against the inside of the cylinder tube 2, while the inner sealing lip 10*c* is completely free, irrespective whether the piston 3 is driven to the right (arrow A in FIG. 1A) by compressed air or it carries out a return movement (arrow B), e.g. under the influence of an unillustrated spring.

During the return movement, when the piston 3 reaches the sleeve portion 5, see FIG. 1B, the inner sealing ring lip 10*e* comes into action and seales the annular space 8, so that the air enclosed therein is forced to flow out via the duct 7 and the constriction 9 while dampening the movement of the piston. If the piston 3 reaches all the way up to the end cap 1*a*, the sealing ring will provide further dampering action as the final position is reached, and above all sound silencing at the impact itself (see also the embodiments according to FIG. 4–6, which are described in more detail below).

When the piston is to be once again displaced to the right away from the end cap 1*a* (see FIG. 1C) compressed air is supplied via the port 6 and the sleeve portion 5 into the central recess 3*a* of the piston. The inner sealing ring lip 10*a* is then shifted away from its engaging position against the outside of the sleeve portion 5, partly by the orientation of the lip 10*e* away from the piston and partly by the web portion 10*d* of the sealing ring serving as a hinge adjacent the outer part of the sealing ring, so that the web portion 10*e* is disengaged from the end surface 3*b* of the piston. The feed pressure will thus also act in the annular space 8, and the piston 3 will be driven to the right with the feed pressure acting over the entire piston area.

Figure 2:
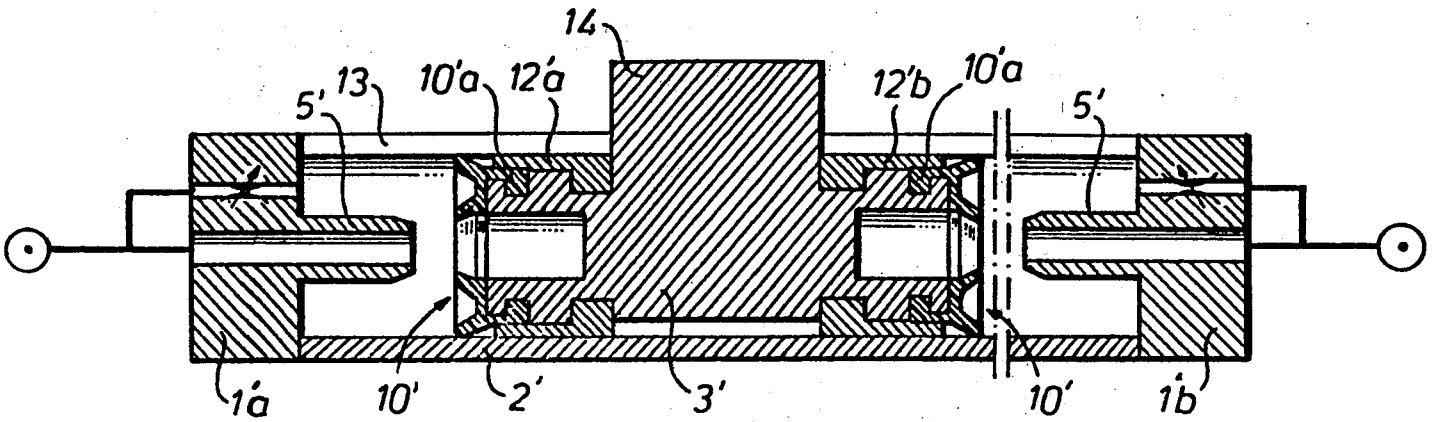
FIG. 2 illustrates the device in a slot cylinder (cylinder without piston rod)
Figure 3:
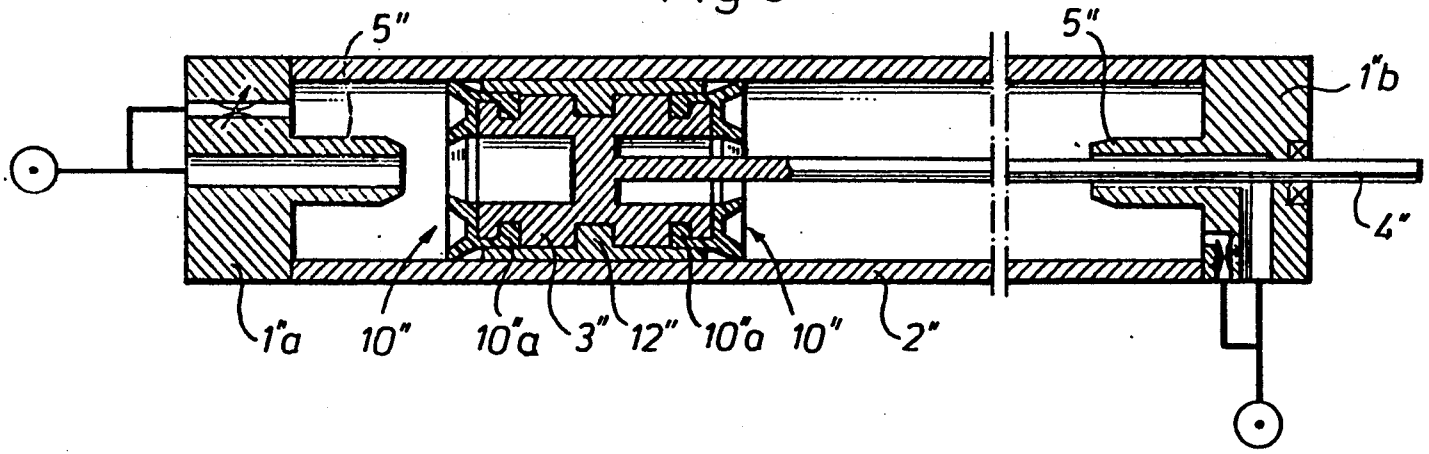
FIG. 3 illustrates the device in a double-acting pressurized-fluid cylinder provided with a piston rod.

It will be seen from FIGS. 2 and 3 that the device can be used for double-action pressurized-fluid cylinders as well (FIG. 3) and for so-called slot cylinders without a piston rod (FIG. 2).

In both these embodiments the respective piston 3' and 3" has a sealing ring 10' and 10" at either end, since the compressed air can be fed through each end cap at 1'a, 1'b and 1"a, 1"b. According to FIG. 2 there is additionally a piston support ring 12'a, 12'b arranged partially around the sealing ring 10' at each piston end, so that the fastening bead 10'a is securely retained in its groove. A single, common piston support ring 12" is used with the piston 3" (FIG. 3), the end portions of this support ring partially sourrounding each sealing ring 10".

For the sake of clarity it is pointed out here that the slot cylinder according to FIG. 2 must of course have at least one sealing strip (not shown) which closes off the longitudinal slot 13 in the cylinder tube 2' between the end caps, and in the region of the piston is guided through a longitudinal passage (not shown either) in the member 14 extending radially out from the piston 3' through the slot 13.

Figure 4:
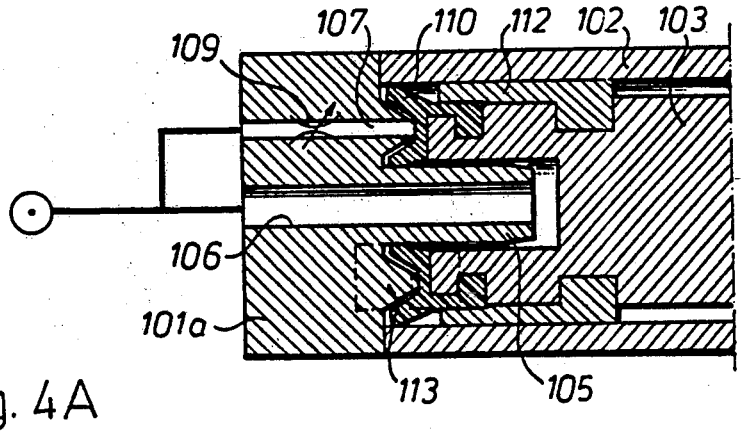
FIGS. 4, 4*a*, FIG. 5 and FIG. 6 illustrate modified embodiments of the device according to the invention, only the end cap and part of the cylinder being shown in central sections.
Figure 4A:
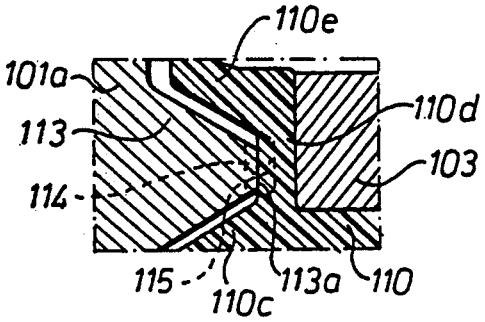

In FIG. 4 there is illustrated a modified embodiment of the device according to FIGS. 1A–1C, corresponding details having been given the same references added by the number 100. Apart from the piston support ring 112 shown here, as in FIGS. 2 and 3, this embodiment is distinguished by the end cap 101a having a portion 113 projecting into the annular space, this portion being illustrated more clearly and to a larger scale in FIG. 4a. The portion 113 extends annularly and tapers in an axial direction to its free, inner, essentially flat end surface 113a, so that the portion 113 is accommodated between the inner and outer sealing ring lips 110e and 110c of the sealing ring 110 (in the end position of the piston as illustrated in FIG. 4), and the end surface 113a forms an abutment surface for the piston 103 with the intermediary of the intermedite web portion 110d of the sealing ring 110. In this way, the lips of the sealing ring can maintain their shape in the end position of the piston as well, particulary during the impact itself, whereby the risk of permanent deformation or damage to these lips is reduced.

To enable the supply of air over the entire piston area, in spite of the web portion 110d engaging sealingly against the end surface 113a in the end position of the piston 103, there are radially extending grooves formed in the end surface 113a (the groove 114 indicated by a dashed line) and/or in the web portion 110d (the groove 115 indicated by a dashed line).

Figure 5:
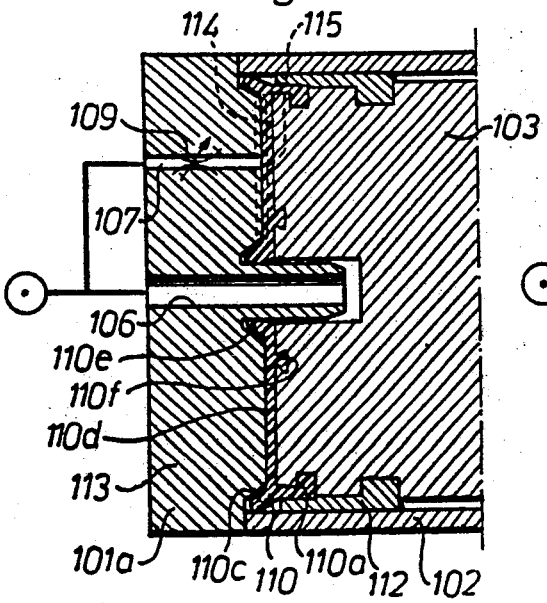
Figure 6:
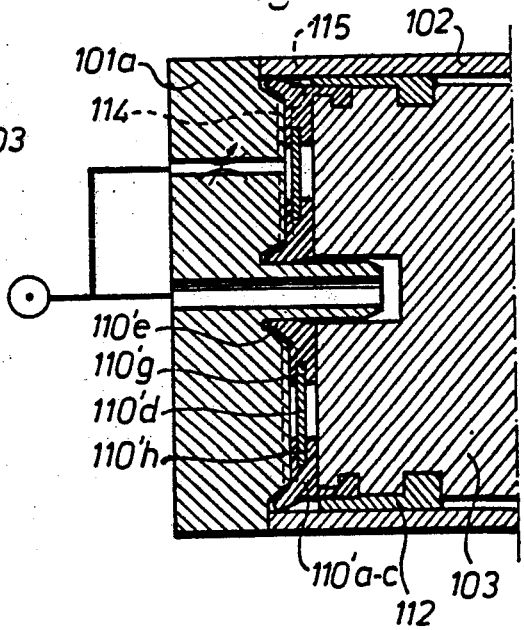

Principally similar embodiments, although for cylinders with larger diameter, are illustrated in FIGS. 5 and 6. The sealing ring 110 in FIG. 5 has a radially larger extension, i.e. a long web portion 110d. In order to keep this web portion 110d in place, so that the major portion of it is kept in engagement against the piston end surface, there is a further fastening bead 110f formed in the radially inward part of the web portion, this bead being urged into an annular groove in the end surface of the piston facing towards the end cap 101a. The extra fastening bead 110f is located at a distance from the inner sealing ring lip 110 such that the portion 110d immediately inwards of the bead 110f serves as a hinge (cf. the embodiment according to FIGS. 1A–1C, 2 and 3) and thereby enables displacement of the inner sealing ring lip 110e when air is fed into the annular space between the cylinder end cap and the piston.

In the embodiment according to FIG. 6, the web portion of the sealing ring is formed as a stiff annular washer 110'd of metal, preferably steel, the radially inward 110'e and outward 110'a–c parts of the sealing having corresponding grooves 110'g, 110'h, in which the annular washer is pressed or vulcanized, so that the composite sealing ring forms a relatively stiff unit with elastic material in the inner and outer parts serving as sealing means.

The device in accordance with the invention can be modified in a plurality of ways within the scope of the following claims. For example, the sleeve portion 5, 105 and the corresponding central recesses in the piston 3, 103 can be formed with a polygonal cross-section (instead of a circular-cylindrical cross-section). The inner sealing lip can then be optionally discontinuous in the corner regions to form there constricted outlets for end position dampening.

Finally, to obtain a fully satisfactory operation, it is essential that no air can leak (see FIG. 1A) from the space between the piston end surface 3b and the web portion 10d, radially inside the axial web portion 10b and passed the fastening bead 10a. This can be ensured, e.g. by having the bead 10a press-fitted in to the associated groove in combination with a tightly surrounding piston support ring which keeps the radially outward part of the sealing ring fixed and in sealing engagement against the corresponding circumferential surface of the piston.

I claim:

1. In the combination of a piston sealing and dampening device in a pressurized-fluid cylinder, having a cylinder tube, cylinder end caps situated at the ends of the cylinder tube, and a piston movable inside the cylinder tube between said end caps, at least one end cap having a central sleeve portion projecting into the cylinder chamber and being provided with an internal pressurized-fluid connection, the piston having a central recess facing towards said at least one end cap such that when the piston is in the vicinity of an end position adjacent said at least one end cap this recess accommodates said sleeve portion, the piston sealing and dampening device including radially inner and outer sealing ring lips adapted such that, during movement of the piston towards said end position under dampening action, these lips seal off an annular space between the cylinder tube and said sleeve portion, characterized in that the piston sealing and dampening device comprises an integrated sealing ring including:

a radially inner part with said inner sealing ring lip for sealing engagement against said sleeve portion under said dampening action;

an intermediate web portion situated in the region of an end surface of the piston facing towards said at least one end cap; and a radially outer part with said outer sealing ring lip for sealing engagement against the inside of the cylinder tube; and, the sealing ring being fastened to the piston at least in said radially outer part such that the inner sealing ring lip is at least partially displaceable from said sleeve portion during the initial stage of the piston movement away from said at least one end cap.

2. Device as claimed in claim 1, characterized in that the sealing ring is fastened to the piston solely at its radially outer part, so that said web portion serves as a hinge.

3. Device as claimed in claim 1, characterized in that the sealing ring has an outer, circumferential bead serving as a fastening part and accommodated in an outward circumferential groove in the piston.

4. Device as claimed in claim 3, characterized in that said bead is axially spaced from said outer sealing ring lip.

5. Device as claimed in claim 1, characterized in that a piston support ring disposed radially outwardly on the piston partially surrounds the outer part of the sealing ring.

6. Device as claimed in claim 5, characterized in that said piston support ring surrounds the sealing ring in the region of said fastening bead.

7. Device as claimed in claim 1, characterized in that the inner and outer sealing ring lips both depart from said web portion and extend at an angle inwardly and outwardly, respectively, in a direction towards the cylinder end cap.

8. Device as claimed in claim 7, characterized in that said cylinder end cap has an annular portion projecting axially inwardly into said annular space and being dimensioned such that, in the end position of the piston, it forms an abutment surface for the web portion of the sealing ring.

9. Device as claimed in claim 8, characterized in that at least one of said annular portion or said web portion have radially extending pressure equalizing grooves.

10. Device as claimed in claim 1, characterized in that said web portion includes a stiff annular washer.

* * * * *